US010389026B2

(12) United States Patent
An et al.

(10) Patent No.: US 10,389,026 B2
(45) Date of Patent: Aug. 20, 2019

(54) METAL BODY ANTENNA HAVING LOOP TYPE RADIATION ELEMENTS

(71) Applicant: ACE TECHNOLOGIES CORPORATION, Incheon (KR)

(72) Inventors: Sung Nam An, Seoul (KR); Won Whi Jin, Bucheon-si (KR); Jun Hee Kim, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 257 days.

(21) Appl. No.: 15/455,242

(22) Filed: Mar. 10, 2017

(65) Prior Publication Data

US 2017/0271765 A1 Sep. 21, 2017

(30) Foreign Application Priority Data

Mar. 18, 2016 (KR) ..... 10-2016-0032567

(51) Int. Cl.

| | |
|---|---|
| ***H01Q 1/24*** | (2006.01) |
| ***H01Q 7/00*** | (2006.01) |
| ***H01Q 21/28*** | (2006.01) |
| ***H01Q 5/335*** | (2015.01) |

(52) U.S. Cl.

CPC ..... *H01Q 7/00* (2013.01); *H01Q 1/243* (2013.01); *H01Q 5/335* (2015.01); *H01Q 21/28* (2013.01)

(58) Field of Classification Search

CPC ..... H01Q 1/243; H01Q 7/00; H01Q 21/28
See application file for complete search history.

(56) References Cited

U.S. PATENT DOCUMENTS

| | | | | |
|---|---|---|---|---|
| 2014/0078008 | A1* | 3/2014 | Kang | H01Q 5/35 343/702 |
| 2015/0123871 | A1* | 5/2015 | Chang | H01Q 1/243 343/872 |
| 2017/0338545 | A1* | 11/2017 | Guo | H01Q 1/243 |

FOREIGN PATENT DOCUMENTS

| | | | |
|---|---|---|---|
| KR | 10-2012-0052005 | A | 5/2012 |
| KR | 10-2012-0094505 | A | 8/2012 |
| KR | 10-2013-0101091 | A | 9/2013 |
| KR | 10-1609542 | B1 | 4/2016 |

* cited by examiner

*Primary Examiner* — Robert Karacsony
(74) *Attorney, Agent, or Firm* — LRK Patent Law Firm

(57) ABSTRACT

A metal body antenna using a housing unit and a battery cover as an antenna. The metal body antenna includes a radiation element supplied with a signal from a feeding power port, a ground coupled to the radiation element by loop coupling to generate an induction current, a frame bezel unit separated from the ground by a dielectric and a gap, and a connection line configured to connect the ground and the frame bezel unit and formed over the dielectric so that an electric current induced into the ground flows into the frame bezel unit, wherein an antenna having an electrical length of a half wavelength operates in a wideband. Accordingly, a bezel unit is effectively used, and a wideband and multi-band antenna structure having a radiation loss satisfies all of the Penta Band (i.e., GSM850, EGSM, DCS, PCS, and W2100), that is, bands chiefly used in mobile phones.

16 Claims, 9 Drawing Sheets

METAL BODY ANTENNA HAVING LOOP TYPE RADIATION ELEMENTS

CROSS-REFERENCE TO RELATED APPLICATION

This application claims priority to Korean patent application number 10-2016-0032567, filed Mar. 18, 2016, the entire disclosure of which is incorporated by reference herein.

BACKGROUND OF THE INVENTION

1. Field of the Invention

The present invention relates to a metal body antenna having loop type radiation elements which operates in a wideband in multiple bands and, more particularly, to a metal body antenna including the housing unit of a terminal and loop type radiation elements having a wideband characteristic in multiple bands, wherein the end part of the radiation element supplied with a signal from a feeding power port formed in the housing unit is connected to a ground and the applied signal is connected to the ground by loop coupling.

2. Description of Related Art

With the recent rapid development of a communication technology, the size and weight of a communication device are reduced and performance of a communication device is further increased.

In particular, most of smart phones are rapidly evolving from the existing second-generation and third-generation communication methods, such as global system for mobile communication (GSM), code division multiple access (CDMA), and wideband CDMA (WCDMA), to a fourth-generation communication method, such as long term evolution (LTE). Furthermore, various technologies, such as Bluetooth, global positioning system (GPS), and Wi-Fi, are integrated.

A single mobile communication terminal may use a plurality of antennas to support various communication methods, but a wideband (or broadband) antenna technology capable of implementing multiple bands using a single antenna has been developed because there is a difficulty in disposing the plurality of antennas within the limited size of the terminal.

The wideband antenna technology has been proposed as a method for supporting various communication bands through the design of an antenna having a wide bandwidth. It is however impossible to improve efficiency of all of bands while implementing multiple bands based on a wide bandwidth. Furthermore, the space in various parts may be disposed is insufficient within the terminal because a wide space is required for the antenna design.

As a method for solving such a problem, a technology in which a housing unit forming an external appearance of a terminal is made of metal and the housing unit operates as an antenna was developed.

If the technology in which the housing unit operates as the antenna as described above is used, a space within the terminal can be additionally secured, more various parts can be disposed in the terminal using the additional space, and a thin type terminal design is made possible.

More specifically, antenna technologies using the housing unit as an antenna, that is, an antenna using a conductive bezel, and a metal battery cover has a disadvantage in that they have a narrow bandwidth. Accordingly, additional technologies, such as a tubable antenna technology in order to support various communication bands, have been additionally applied.

Furthermore, several problems, such as a rise of a production cost attributable to the application of the tubable antenna technologies, an increase of the design period attributable to added parts, and a rise of power consumption, are accompanied.

Accordingly, there is an urgent need for an antenna design technology which can utilize a space within the terminal as much as possible and achieve a smaller size and has a wide bandwidth even without using an additional technology by forming the casing of a housing unit forming an external appearance of the terminal using a metal material so that the housing unit operates as an antenna.

In order to solve such conventional problems, Korean Patent No. 10-1609542 entitled "Metal-Body Antenna to Operating Wideband in a Multi-Band" was proposed.

As the terminal tends to become slim, the PCB area of the terminal recently tends to be designed by avoiding parts, such as a speaker and a battery. In such a case, an extension cable is required because the feeding power port 8*a* of an existing antenna deviates from the area of a PCB 2*a* as shown in FIG. 1*a*, and there is a difficulty in the antenna design. In order to supplement such a disadvantage, there is a need for an antenna design in which a feeding power port 8*b* shown in FIG. 1*b* is disposed within the area of a PCB 2*b*.

SUMMARY OF THE INVENTION

In accordance with an embodiment of the present invention, an object of the present invention is to provide a metal body antenna having loop type radiation elements, which has a small radiation loss and shows a wideband characteristic in multiple bands using a frame bezel unit.

In accordance with another embodiment of the present invention, another object of the present invention is to provide an antenna having loop type radiation elements and showing a wideband characteristic in multiple bands, wherein a radiation element supplied with a signal from a feeding power port is connected to a ground in a loop form without having a coupling structure in which the radiation element supplied with a signal from the feeding power port is coupled to a frame bezel unit as a radiation element connected to the ground.

In accordance with another embodiment of the present invention, another object of the present invention is to provide a metal body antenna having loop type radiation elements and showing a wideband characteristic in multiple bands, wherein a radiation element supplied with a signal from a feeding power port induces an electric current into a ground, electrical energy is concentrated on the end part of a bezel unit opened by the gap of a frame bezel unit by a surface current that flows into the frame bezel unit, that is, a radiation element connected to the ground, by the electric current induced into the ground, and magnetic energy is concentrated on a connection line that connects the frame bezel unit and the ground.

In accordance with another embodiment of the present invention, another object of the present invention is to provide a metal body antenna having loop type radiation elements and showing a wideband characteristic in multiple bands, wherein an L-C element is inserted to a feeding power port and perfect impedance matching with the antenna unit in an operating frequency band is performed.

In accordance with an embodiment of the present invention, a metal body antenna having loop type radiation elements includes a housing unit forming an external appearance of a terminal; a first antenna unit having an electrical length of a half wavelength and including a first radiation element supplied with a signal of a low frequency band from a first feeding power port formed in the housing unit, a second radiation element supplied with a signal of a high frequency band from a second feeding power port formed in the housing unit, a ground coupled to the first and the second radiation elements by loop coupling and formed in the housing unit, a connection line connected to the ground, and a bezel unit connected to the connection line and opened by a gap; and a second antenna unit having an electrical length of a half wavelength and including a bezel unit connected to the connection line and opened by a gap.

In accordance with another embodiment of the present invention, a metal body antenna having loop type radiation elements includes a radiation element supplied with a signal from a feeding power port; a ground coupled to the radiation element by loop coupling to generate an induction current; a frame bezel unit separated from the ground by a dielectric and a gap; and a connection line configured to connect the ground and the frame bezel unit and formed over the dielectric so that an electric current induced into the ground flows into the frame bezel unit, wherein a small-sized antenna having an electrical length of a half wavelength operates in a wideband.

In accordance with another embodiment of the present invention, a metal body antenna having loop type radiation elements includes a radiation element supplied with a signal from a feeding power port; a ground coupled to the radiation element by loop coupling to generate an induction current; a frame bezel unit separated from the ground by a dielectric and a gap; and a connection line configured to connect the ground and the frame bezel unit and formed over the dielectric so that an electric current induced into the ground flows into the frame bezel unit, wherein an antenna having an electrical length of a half wavelength operates in a wideband in multiple bands.

In accordance with another embodiment of the present invention, there is provided a metal body antenna having loop type radiation elements and operating in a wideband in multiple bands, the metal body antenna being formed in a housing unit of a terminal and including rectangular ground surfaces made of a metal material and a frame bezel unit surrounding outermost edge parts of the rectangular ground surfaces and having a frame made of metal, wherein the upper frame bezel unit of the housing unit includes an upper bezel unit and side bezel units. The meal body antenna includes gaps formed to maintain specific openings at locations of specific lengths from the top of the left and right side bezel units extended from end corner parts of the upper bezel unit to a bottom, an upper frame bezel unit separated by the gaps, dielectrics formed in a specific width between the rectangular ground surfaces, and the upper bezel unit and the side bezel units of the left and right frames separated from a ground by the gaps and the dielectrics. The meal body antenna further includes first and second feeding power ports formed in a specific portion adjacent to the dielectrics above the ground; a first radiation element connected to the first feeding power port, supplied with an electromagnetic signal, and having an end part disconnected at a specific height with respect to the ground; a second radiation element connected to the second feeding power port, supplied with an electromagnetic signal, and having an end part disconnected at a specific height with respect to the ground; a connection line having an electromagnetic signal coupled to the first and the second radiation elements by loop coupling so that an induction current is generated in the ground formed below the first and the second radiation elements and connected to the ground in order to connect the ground and an upper bezel unit of the upper frame bezel unit separated by the gaps and the dielectrics; and first and second antenna units each including a side bezel unit having an end part open by the gap from the upper bezel unit connected to the connection line.

In accordance with another embodiment of the present invention, a metal body antenna having loop type radiation elements and operating in a wideband in multiple bands, the metal body antenna includes a housing unit forming an external appearance of a terminal; first and second antenna units each having an electrical length of a half wavelength and including a first radiation element supplied with a signal of a low frequency band from a first feeding power port formed in the housing unit, a second radiation element supplied with a signal of a high frequency band from a second feeding power port formed in the housing unit, a ground coupled to the first and the second radiation elements by loop coupling and formed in the housing unit, a connection line connected to the ground, and frame bezel units connected to the connection line and opened by gaps; and a separate gap formed in the open frame bezel unit, separating the open frame bezel unit and the connection line dually, and transferring an electromagnetic signal to the separated open frame bezel units through the separated connection lines.

In accordance with another embodiment of the present invention, a metal body antenna having loop type radiation elements and operating in a wideband in multiple bands, the metal body antenna includes a housing unit of a terminal; a metal frame bezel unit formed in the outskirt of the housing unit; a first gap formed by cutting part of the frame bezel unit; a ground separated from part of the frame bezel unit separated by the first gap at a specific interval; a connection line including a second gap for separating the frame bezel unit separated by the first gap, electrically connecting part of the frame bezel unit separated by the second gap and the ground, and electrically connecting another part of the separated frame bezel unit and the ground; first and second radiation elements coupled to the ground by electromagnetic loop coupling; a first feeding power port formed in the housing unit, for applying a signal of a low frequency band to the first radiation element; and a second feeding power port formed in the housing unit, for applying a signal of a high frequency band to the second radiation element, wherein a signal subjected to electromagnetic loop coupling and transferred from the first radiation element to the ground is transmitted to the frame bezel unit separated by the first gap through the connection line so that electromagnetic waves are radiated, a signal subjected to electromagnetic loop coupling and transferred from the second radiation element to the ground is transmitted to another frame bezel unit separated by the second gap through the connection line so that electromagnetic waves are radiated.

In accordance with another embodiment of the present invention, a metal body antenna having loop type radiation elements and operating in a wideband in multiple bands, the metal body antenna includes a terminal housing unit; a metal frame bezel unit formed in the outskirt of the terminal housing unit; a gap formed by cutting part of the frame bezel unit; a ground electrically connected to the frame bezel unit separated by the gap and spaced apart from part of the frame bezel unit including the gap at a specific interval; a connection line connected to the ground; first and second radiation elements formed in the ground and coupled to the ground by electromagnetic loop coupling; a first feeding power port formed in the terminal housing unit, for applying a signal of a low frequency band to the first radiation element; and a second feeding power port formed in the terminal housing unit, for applying a signal of a high frequency band to the second radiation element.

In accordance with another embodiment of the present invention, a metal body antenna having loop type radiation elements and operating in a wideband in multiple bands, the metal body antenna includes a terminal housing unit; a metal frame bezel unit formed in the outskirt of the terminal housing unit; a gap formed by cutting part of the frame bezel unit; a ground spaced apart from part of the frame bezel unit separated by the gap at a specific interval; a connection line connected to the ground, wherein part of the other side of the frame bezel unit on one side separated by the gap and the ground are connected, and part of the other side of the frame bezel unit on the other side separated by the gap and the ground are connected; first and second radiation elements coupled to the ground by electromagnetic loop coupling; a first feeding power port formed in the terminal housing unit, for applying a signal of a low frequency band to the first radiation element; and a second feeding power port formed in the terminal housing unit, for applying a signal of a high frequency band to the second radiation element, wherein a signal subjected to electromagnetic loop coupling and supplied from the first radiation element to the ground is transmitted to one frame bezel unit separated by the gap connected to the ground and radiated, and a signal subjected to electromagnetic loop coupling and supplied from the second radiation element to the ground are transmitted to the other frame bezel unit separated by the gap connected to the ground and radiated.

In the metal body antenna having loop type radiation elements according to another embodiment of the present invention, the first radiation element and the second radiation element are formed on both sides of the ground based on the connection line and operate in a wideband in multiple bands.

In the metal body antenna having loop type radiation elements according to another embodiment of the present invention, an L-C element is inserted between the first and the second feeding power ports and the first and the second radiation elements so that impedance is matched and the first and the second radiation elements operate in a wideband in multiple bands.

In the metal body antenna having loop type radiation elements according to another embodiment of the present invention, the radiation element coupled to the ground by loop coupling has a small size and disposed at a specific location in a space between the end part of the frame bezel unit and the connection line.

DETAILED DESCRIPTION OF THE EMBODIMENTS

Figure 1A:
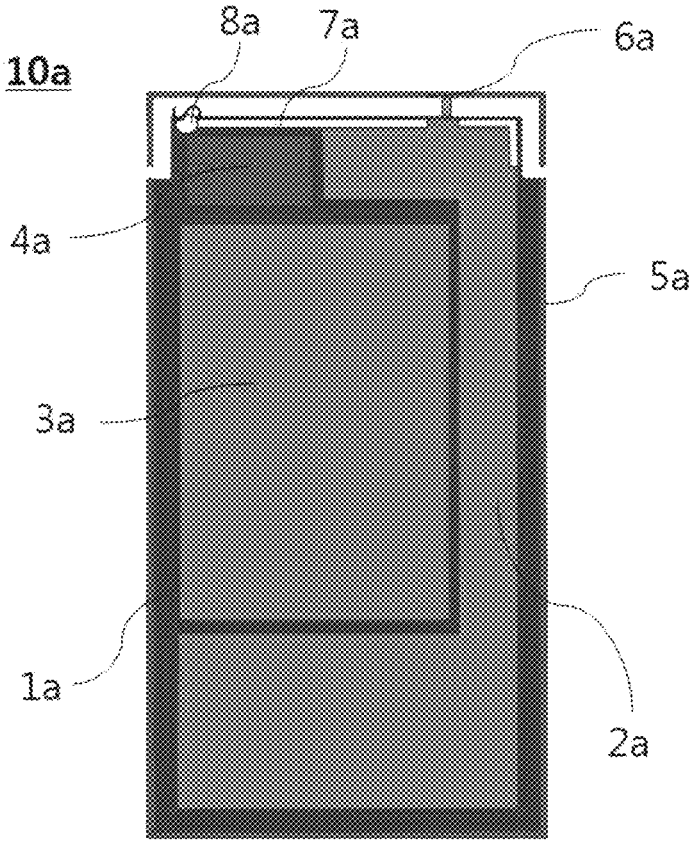
FIG. 1A RELATED ART
FIG. 1*a* is a case where a radiation element according to a conventional technology is a monopole type and shows the configuration of parts of a mobile terminal.

Hereinafter, embodiments of the present invention will be described in detail with reference to the accompanying drawings. The same elements are assigned the same reference numerals. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc. of components in the drawings may be exaggerated to make the description clear.

Embodiments of a metal body antenna are described in detail below with reference to the accompanying drawings.

Figure 2:
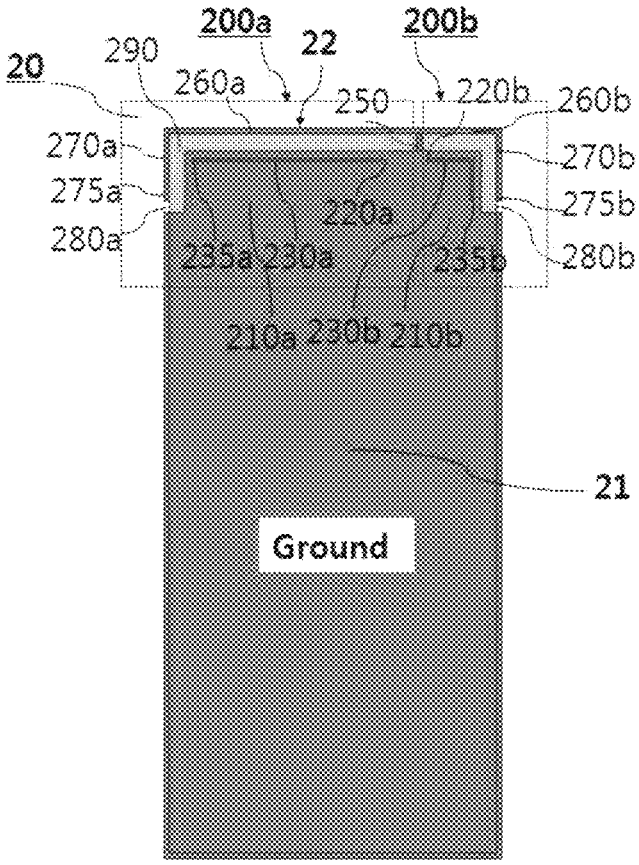
FIG. 2 is a plan view showing a representative structure of a metal body antenna having loop type radiation elements formed in the housing unit of the terminal in accordance with an embodiment of the present invention.

FIG. 1*a* is a case where a radiation element according to a conventional technology is a monopole type and shows the configuration of parts of a mobile terminal. FIG. 2 is a plan view showing a representative structure of a metal body antenna having loop type radiation elements formed in the housing unit of the terminal in accordance with an embodiment of the present invention.

Figure 1B:
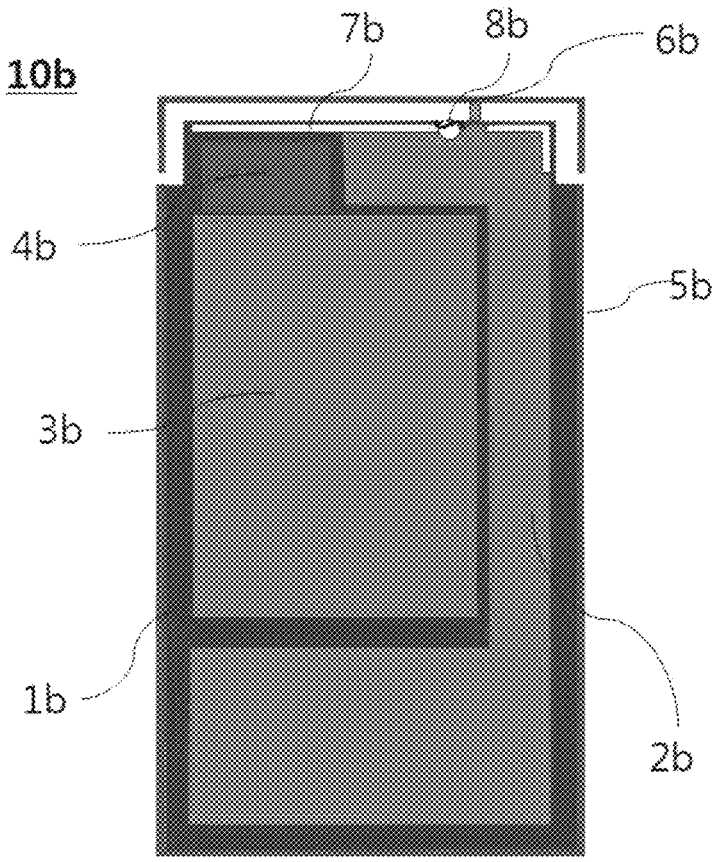
FIG. 1*b* is a case where a radiation element according to an embodiment of the present invention is a loop type and shows the configuration of parts of a mobile terminal.

Referring to FIGS. 1*b* and 2, the metal body antenna having loop type radiation elements according to an embodiment of the present invention is mounted on the housing unit 20 of a terminal. The housing unit 20 includes a rectangular ground 21 made of a metal material and formed to occupy most of the area of the housing unit 20 and a frame bezel unit 22 on the upper side made of a metal material and formed to surround the outermost edge part of the rectangular ground.

The ground 21 of the housing unit 20 provides a ground voltage within the terminal and may form a board on which circuit elements and parts necessary for the operation of the terminal are mounted.

More specifically, the metal body antenna formed in the housing unit 20 according to an embodiment of the present invention includes grounds 210*a* and 210*b* of a ground region on the upper side indicated by dotted lines, first and second feeding power ports 220*a* and 220*b* including two ports, two first and second radiation elements 230*a* and 230*b*, a common connection line 250, an upper bezel unit 260, that is, first and second bezel units 260*a* and 260*b* on the upper part of the frame bezel unit 22 on the upper side, first and second side bezel units 270*a* and 270*b* on the left and right sides of side units, and gaps 280*a* and 280*b* and a dielectric 290 formed in the first and the second side bezel units 270*a* and 270*b*.

Furthermore, the metal body antenna formed in the housing unit 20 according to an embodiment of the present invention includes a first antenna unit 200*a* operating in a low frequency band and a second antenna unit 200*b* operating in a high frequency band.

That is, in accordance with an embodiment of the present invention, each of the first and the second antenna units 200*a* and 200*b* is an antenna having an electrical length of a half wavelength. That is, the metal body antenna according to an embodiment of the present invention is formed dually or solely like the first antenna unit 200*a* and the second antenna unit 200*b*. The first antenna unit 200*a* operates in a low frequency band and the second antenna unit 200*b* operates in a high frequency band, and thus the metal body antenna operates in a wideband in multiple bands. The first antenna unit 200*a* operates at 824 MHz~960 MHz, that is, a frequency of GSM850 and EGSM of a low frequency band. The second antenna unit 200*b* operates at 1710 MHz~2170 MHz, that is, a frequency of DCS, PCS or W2100 of a high frequency band.

The first antenna unit 200*a* includes the ground 210*a*, the first feeding power port 220*a*, the first radiation element 230*a*, the connector line 250, the first bezel unit 260*a*, the first side bezel unit 270*a*, the gap 280*a*, and the dielectric 290 in the upper ground region indicated by dotted lines. Accordingly, the first antenna unit 200*a* is formed so that the end part 275*a* of the first side bezel unit 270*a* is opened by the gap 280*a*.

Furthermore, the second antenna unit 200*b* includes the ground 210*b*, the second feeding power port 220*b*, the second radiation element 230*b*, the connector line 250, the second bezel unit 260*b*, the second side bezel unit 270*b*, the gap 280*b*, and the dielectric 290 in the upper ground region indicated by dotted lines. Accordingly, the second antenna unit 200*b* is formed so that the end part 275*b* of the right bezel unit 270*b* is opened by the gap 280*b*.

The two first and the second feeding power ports 220*a* and 220*b* are formed to be not connected to the grounds 210*a* and 210*b* in the upper ground region indicated by dotted lines, that is, the ground 21 on the upper side which neighbors the dielectric 290, and thus function to supply an electromagnetic signal from the RF module of a terminal to the first and the second antenna units 200*a* and 200*b*.

Furthermore, in some embodiments, L-C elements are inserted into the first and the second feeding power ports 220*a* and 220*b*, respectively, so that the first and the second feeding power ports 220*a* and 220*b* are perfectly matched with the first and the second antenna units 200*a* and 200*b* in respective operating frequency bands, thereby achieving impedance matching.

The first radiation element 230*a* is connected to the first feeding power port 220*a* and supplied with an electromagnetic signal. The first radiation element 230*a* has a specific height and length with respect to the ground 210*a* and is configured to have an end part 235*a* disconnected.

The second radiation element 230*b* is connected to the second feeding power port 220*b* and supplied with an electromagnetic signal. The second radiation element 230*b* has a specific height and length with respect to the ground 210*b* and is configured to have an end part 235*b* disconnected.

The first and the second radiation elements 230*a* and 230*b* may be formed on the upper side of the ground 21 or the dielectric 290 in order to utilize the space of the housing unit 20.

Accordingly, the first and the second radiation elements 230*a* and 230*b* supplied with electromagnetic signals from the first and the second feeding power ports 220*a* and 220*b* transfer the electromagnetic signals to the grounds 210*a* and 210*b* by loop coupling.

The connection line 250 is a common connection line which connects the grounds 210*a* and 210*b* and the upper bezel unit 260 of the frame bezel unit 22. Accordingly, an electromagnetic signal is transferred from the grounds 210*a* and 210*b* to the first and the second bezel units 260*a* and 260*b* of the first and the second antenna units 200*a* and 200*b* by the connection line 250. Furthermore, the electromagnetic signal transferred by each of the first bezel unit 260*a* of the first antenna unit 200*a* and the second bezel unit 260*b* of the second antenna unit 200*b* is branched by the connection line 250.

Furthermore, in some embodiments, an L-C element may be inserted between the ground 210*a* or 210*b* and the connection line 250 in order to adjust the operating frequency of the first antenna unit 100*a* and the second antenna unit 200*b*.

Furthermore, the upper bezel unit 260 of the frame bezel unit 22 includes the first bezel unit 260*a* on the left side of the first antenna unit 200*a* and the second bezel unit 260*b* on the right side of the second antenna unit 200*b*, which surround the outermost edge parts of the rectangular ground 21 connected to the connection line 250.

In the case of the first antenna unit 200*a*, the first side bezel unit 270*a* on the left surface of the frame bezel unit 22 is vertically extended in the end corner part of the left first bezel unit 260*a*. In the case of the second antenna unit 200*b*, the second side bezel unit 270*b* on the right surface of the frame bezel unit 22 is also vertically extended in the end corner part of the right second bezel unit 260*b*.

Each of the gaps 280*a* and 280*b* is formed to maintain a specific opening at a location of a specific length from the top of each of the first and the second side bezel units 270*a* and 270*b* to the bottom. Accordingly, the gaps 280*a* and 280*b* are formed to have the open end parts 275*a* and 275*b* in the first and the second side bezel units 270*a* and 270*b*, respectively.

The dielectric 290 formed to have a specific width is provided between the rectangular ground 21 and the bezel unit 260, that is, a frame separated from the left and right surfaces by the gaps 280*a* and 280*b*.

Accordingly, the frame bezel unit 22, including the first and the second bezel units 260*a* and 260*b* of the upper bezel unit 260 and the first and the second side bezel units 270*a* and 270*b* of the bezel unit 270 of the side unit, is separated from the ground 21 by the gaps 280*a* and 280*b* and the dielectric 290.

Figure 3A:
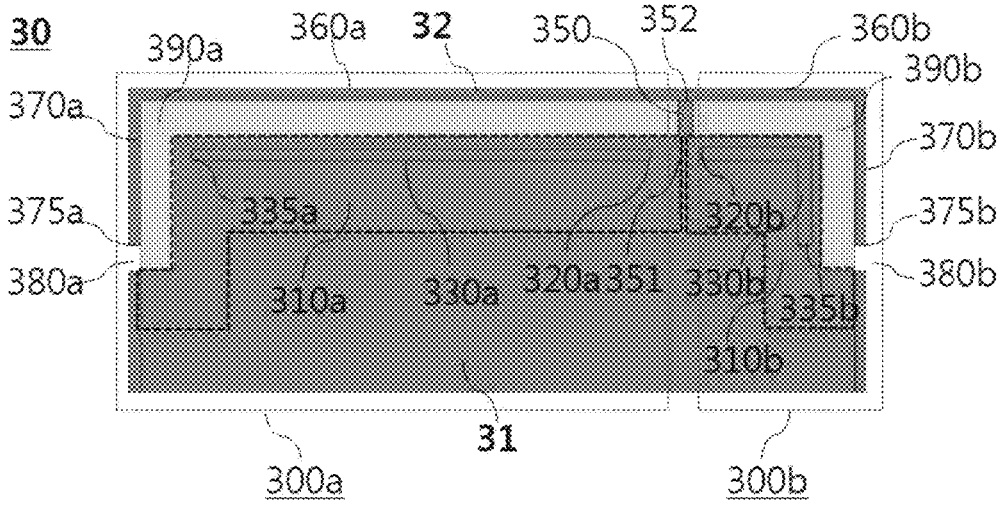
FIG. 3*a* is a case where the radiation element connected to a feeding power port is linear in FIG. 2 and is a detailed plan view showing an enlarged structure of the metal body antenna having loop type radiation elements.
Figure 3B:
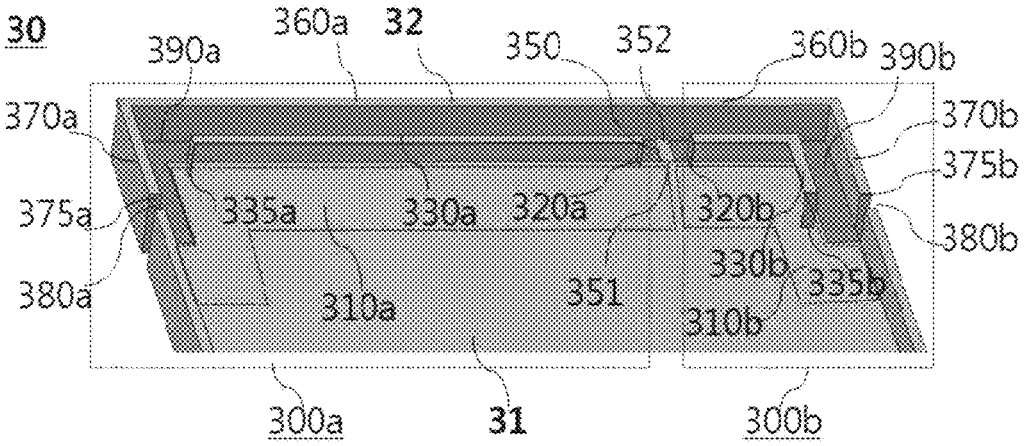
FIG. 3*b* is a case where the radiation element connected to the feeding power port is linear in FIG. 2 and is a detailed perspective view showing an enlarged structure of the metal body antenna having loop type radiation elements.

FIG. 3*a* is a case where the radiation element connected to the feeding power port is linear in FIG. 2 and is a detailed plan view showing an enlarged structure of the metal body antenna having loop type radiation elements. FIG. 3*b* is a case where the radiation element connected to the feeding power port is linear in FIG. 2 and is a detailed perspective view showing an enlarged structure of the metal body antenna having loop type radiation elements.

The metal body antenna according to an embodiment of the present invention is described in detail with reference to FIGS. 2 and 3*a* and 3*b*.

The metal body antenna formed in a housing unit 30 according to an embodiment of the present invention includes grounds 310*a* and 310*b* of an upper ground region indicated by dotted lines, first and second feeding power ports 320*a* and 320*b* including two ports, two first and second radiation elements 330*a* and 330*b*, a common connection line 350, a bezel unit 360, that is, first and second bezel units 360*a* and 360*b* on the upper part, first and second side bezel units 370*a* and 370*b* on the left and right side of a side unit, first and second gaps 380*a* and 380*b* formed in the first and the second side bezel units 370*a* and 370*b*, respectively, and dielectrics 390*a* and 390*b*.

In accordance with an embodiment of the present invention, FIG. 3*a* relates to a metal body antenna having a linear structure in which the first and the second radiation elements 330*a* and 330*b* are the radiation elements connected to the feeding power ports in FIG. 2. Accordingly, in some embodiments, the first and the second radiation elements 330*a* and 330*b* in the structure of FIGS. 3*a* and 3*b* are also called first and second linear radiation elements 330*a* and 330*b*.

The metal body antenna formed in the housing unit 30 according to an embodiment of the present invention includes a first antenna unit 300*a* operating in a low frequency band and a second antenna unit 300*b* operating in a high frequency band.

That is, in accordance with an embodiment of the present invention, each of the first and the second antenna units 300*a* and 300*b* is an antenna having an electrical length of a half wavelength. The metal body antenna according to an embodiment of the present invention is a loop type antenna having a dual structure, such as the first antenna unit 300*a* and the second antenna unit 300*b*. The first antenna unit 300*a* operates in a low frequency band and the second antenna unit 300*b* operates in a high frequency band, thus operating in a wideband in multiple bands. The first antenna unit 300*a* operates at 824 MHz~960 MHz, that is, a frequency of GSM850 and EGSM of a low frequency band. The second antenna unit 300*b* operates at 1710 MHz~2170 MHz, that is, a frequency of DCS, PCS or W2100 of a high frequency band.

In the metal body antenna of FIGS. 3*a* and 3*b* according to an embodiment of the present invention, the first and the second radiation elements 330*a* and 330*b* have a linear structure, and the first bezel unit 360*a* and the second bezel unit 360*b* are supplied with an electromagnetic signal from the connection line 350 from a common location having the same start point.

The configuration of the first antenna unit 300*a* is described below. The first antenna unit 300*a* operates in a low frequency band, and includes the first linear radiation element 330*a*, the ground 310*a* of the ground region indicated by dotted lines, the connection line 350, the first bezel unit 360*a*, the first side bezel unit 370*a*, the first gap 380*a*, and the dielectric 390*a*.

The first feeding power port 320*a* connected to the first linear radiation element 330*a* is disposed at a location close to the connection line 350. The end of the first linear radiation element 330*a* is disconnected at a location close to the end part 375*a* of the first side bezel unit 370*a*, and supplies an electromagnetic signal of a low frequency band from the RF module of a terminal to the first antenna unit 300*a*.

Furthermore, in some embodiments, an L-C element is inserted into the first feeding power port 320*a* so that perfect matching with the first antenna unit 300*a* is performed in a low frequency band, thereby achieving impedance matching.

The first linear radiation element 330*a* is connected to the first feeding power port 320*a* and supplied with an electromagnetic signal. The first linear radiation element 330*a* is linearly formed at a specific height with respect to the ground 310*a* of the upper ground region and is formed to have a disconnected end part 335*b*.

Accordingly, when the first linear radiation element 330*a* supplied with the electromagnetic signal from the first feeding power port 320*a* transfers the electromagnetic signal to the ground 310*a* of the upper ground region indicated by dotted lines and located below the first linear radiation element 330*a* by loop coupling, an induction current is generated in the ground 310*a*. The disconnected end part 335*a* of the first linear radiation element 330*a* is disposed at a location close to the end part 375*a* of the first side bezel unit 370*a*.

The first radiation element 330*a* may be formed on the upper side of the ground 310*a* or the dielectric 390*a* in order to utilize the space of the housing unit 30. The connection line 350 is a common connection line which connects the ground 310*a* and the upper bezel unit 360 of a frame bezel unit 32 on the upper side. The connection line 350 connects the first connection point 351 of the ground 310*a* and the second connection point 352 of the upper bezel unit 360 of the frame bezel unit 32.

Furthermore, an L-C element is inserted between the ground 310*a* or 310*b* and the first connection point 351 of the connection line 350 in order to adjust the operating frequency of the first antenna unit 300*a* and the second antenna unit 300*b*.

Accordingly, an electromagnetic signal is transferred from the ground 310*a* to the first bezel unit 360*a* of the first antenna unit 300*a* by the connection line 350. The second connection point 352 becomes the start point of the first bezel unit 360*a*.

Furthermore, the first bezel unit 360*a* of the first antenna unit 300*a* is the left upper bezel unit 360 of the frame bezel unit 32 that surrounds an upper edge part in the outermost part of a rectangular ground 31 connected to the connection line 350. An electromagnetic signal transferred by the connection line 350 is branched and transferred by the second connection point 352.

The first side bezel unit 370*a* is located at the end corner part of the first bezel unit 360*a* and extended from the first bezel unit 360*a* in a direction vertical to the left surface of the frame bezel unit 32. The open end part 375*a* is formed in the first side bezel unit 370*a*.

The first gap 380*a* is formed to have a specific opening at a location of a specific length from the top of the first side bezel unit 370*a* to the bottom, thereby forming the open end part 375*a* of the first side bezel unit 370*a*.

The dielectric 390*b* formed to have a specific width is provided between the frame bezel unit 32 and the rectangular ground 31 separated by the first and the second gaps 380*a* and 380*b*.

That is, the frame bezel unit 32, including the first and the second bezel units 360*a* and 360*b* of the upper bezel unit 360 and the first and the second side bezel units 370*a* and 370*b* of the side bezel unit 370, is separated from the ground 31 by the first and the second gaps 380*a* and 380*b* and the dielectrics 390*a* and 390*b*.

Accordingly, the first antenna unit 300*a* is configured to include the first feeding power port 320*a*, that is, a first port formed in a specific portion within the area of the upper-side ground 31 in such a way as to be not connected to the ground 310*a* of the upper ground region adjacent to the dielectric 390*a* and indicated by dotted lines; the first linear radiation element 330*a* connected to the first feeding power port 320*a*, supplied with an electromagnetic signal, linearly formed in a specific height with respect to the ground 310*a*, and equipped with the disconnected end part 335*a*; the connection line 350 having an electromagnetic signal connected to the ground 310*a* formed below the first linear radiation element 330*a* by loop coupling, connected to the first ground 310*a*, and formed in the dielectric 390*a* as a connection part connected to the frame bezel unit 32 separated by the dielectric 390*a* and the gap 380*a*; and the first bezel unit 360*a* and the first side bezel unit 370*a* separated by the first gap 380*a* and the dielectric 390*a* from the upper bezel unit 360, that is, a point connected to the connection line 350, to the first gap 380*a* of the left frame of the frame bezel unit 32.

An operating principle according to the configuration of the first antenna unit 300*a* is described below.

When an electromagnetic signal is applied to the first feeding power port 320*a*, the first linear radiation element 330*a* generates an induction current by the loop coupling of electromagnetic signals along with the ground 310*a*. An electric current induced into the ground 310*a* flows into the first bezel unit 360*a* through the connection line 350. Electric energy is concentrated on the end part 375*a* of the first side bezel unit 370*a* due to a flow of a surface current. Magnetic energy is concentrated on the connection line 350 that connects the first bezel unit 360*a* and the ground 310*a*. The first antenna unit 300*a* has an electrical length of a half wavelength in an operating frequency of a low frequency band and shows a wideband characteristic as in a reflection loss indicated by a solid line 301 of FIG. 3*c*.

The configuration of the second antenna unit 300*b* is described below. The configuration and operating principle of the second antenna unit 300*b* are the same as those of the first antenna unit 300*a* other than the operating frequency.

The second antenna unit 300*b* is an antenna element operating in a high frequency band, and includes the second linear radiation element 330*b*, the ground 310*b*, the connection line 350, the second bezel unit 360*b*, the second side bezel unit 370*b*, and the dielectric 390*b*.

The second feeding power port 320*b* connected to the second linear radiation element 330*b* is disposed at a location close to the connection line 350. The end of the second linear radiation element 330*b* is disconnected at the place close to the end part 375*b* of the second side bezel unit 370*b*. The second linear radiation element 330*b* supplies a low frequency band of an electromagnetic signal from the RF module of a terminal to the second antenna unit 300*b*.

Furthermore, in some embodiments, an L-C element is inserted into the second feeding power port 320*b* so that perfect matching with the second antenna unit 300*b* is performed in a high frequency band, thereby achieving impedance matching.

The second linear radiation element 330*b* is connected to the second feeding power port 320*b* and supplied with an electromagnetic signal. The second linear radiation element 330*b* is linearly formed at a specific height with respect to the ground 310*b* of the upper-side ground region and is formed to have the disconnected end part 335*b*. Accordingly, when the second linear radiation element 330*b* supplied with the electromagnetic signal from the second feeding power port 320*b* transfers the electromagnetic signal to the ground 310*b* of the upper ground region indicated by dotted lines below the second linear radiation element 330*b* by loop coupling, an induction current is generated in the ground 310*b*. The disconnected end part 335*b* of the second linear radiation element 330*b* is disposed at a point close to the end part 375*b* of the second side bezel unit 370*b*.

The second radiation element 330*b* may be formed on the upper side of the ground 310*b* or the dielectric 390*b* in order to utilize the space of the housing unit 30.

The connection line 350 is a common connection line which connects the ground 310*b* and the upper bezel unit 360 of the frame bezel unit 32. The connection line 350 connects the first connection point 351 of the ground 310*b* and the second connection point 352 of the upper bezel unit 360 of the upper frame bezel unit.

Accordingly, an electromagnetic signal is transferred from the ground 310*b* to the second bezel unit 360*b* of the second antenna unit 300*b* by the connection line 350. The second connection point 352 becomes the start point of the second bezel unit 360*b*.

Furthermore, the second bezel unit 360*b* of the second antenna unit 300*b* is the right bezel unit of the upper bezel unit 360 that surrounds an upper edge part in the outermost part of the rectangular ground 31 connected to the connection line 350. An electromagnetic signal transferred by the connection line 350 is branched and transferred by the second connection point 352.

The second side bezel unit 370*b* is located at the end corner part of the second bezel unit 360*b* and extended from the second bezel unit 360*b* in a direction vertical to the right surface of the frame bezel unit 32. The open end part 375*b* is formed in the second side bezel unit 370*b*.

The second gap 380*b* is formed to maintain a specific opening at a location of a specific length from the top of the second side bezel unit 370*b* to the bottom, and thus forms the open end part 375*b* of the second side bezel unit 370*b*.

The dielectric 390*b* formed to have a specific width is provided between the frame bezel unit 32 and the rectangular ground 31 separated by the first and the second gaps 380*a* and 380*b*.

That is, the frame bezel unit 32, including the first and the second bezel units 360*a* and 360*b* of the upper bezel unit 360 and the first and the second side bezel units 370*a* and 370*b* of the side bezel unit 370, is separated from the ground 31 by the gap 380*a* and 380*b* and the dielectrics 390*a* and 390*b*.

Accordingly, the second antenna unit 300*b* includes the second feeding power port 320*b*, that is, a second port formed to be not connected to the ground 310*b* of the area of the ground 31 adjacent to the dielectric 390*b* and indicated by dotted lines; the second linear radiation element 330*b* connected to the second feeding power port 320*b*, supplied with an electromagnetic signal, linearly formed at a specific height with respect to the ground 310*b*, and equipped with the disconnected end part 335*b*; the connection line 350 having an electromagnetic signal connected to the ground 310*a* formed below the second radiation element 330*b* by loop coupling, connected the ground 310*b*, and formed in the dielectric 390*b* as a connection part connected to the upper bezel unit 360 of the frame bezel unit 32 separated by the dielectric 390*a* and the second gap 380*b*; and the second bezel unit 360*b* and the second side bezel unit 370*b* separated by the dielectric 390*b* and the second gap 380*b* from the upper bezel unit 360, that is, a point connected to the connection line 350, to the second gap 380*b* of the right frame of the upper bezel unit 360.

An operating principle according to the configuration of the second antenna is described below.

When an electromagnetic signal is applied to the second feeding power port 320*b*, the second linear radiation element 330*b* generates an induction current by the looping coupling of electromagnetic signals along with the ground 310*b*. An electric current induced into the ground 310*b* flows into the second bezel unit 360*b* through the connection line 350. Electric energy is concentrated on the end part 375*b* of the second side bezel unit 370*b* due to a flow of a surface current. Magnetic energy is concentrated on the connection line 350 that connects the second bezel unit 360*b* and the ground 310*b*. The second antenna unit 300*b* has an electrical length of a half wavelength in an operating frequency of a high frequency band and shows a wideband characteristic as in a reflection loss indicated by dotted lines 302 of FIG. 3*c*.

Figure 3C:
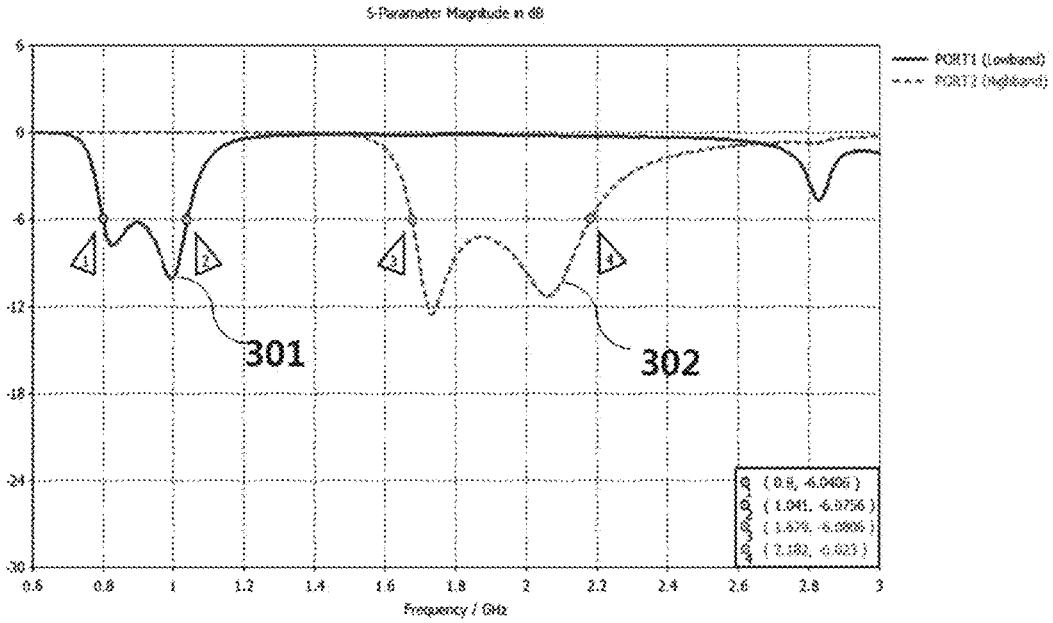
FIG. 3*c* is a case where the radiation element connected to the feeding power port is linear in FIGS. 3*a* and 3*b* and shows a reflection loss of the metal body antenna.

FIG. 3*c* is a diagram showing a reflection loss of the metal body antenna of FIGS. 3*a* and 3*b*.

Referring to FIG. 3*c*, the range of an operating frequency in a low frequency band is from about 800 MHz to about 1041 MHz based on a reflection loss −6 dB indicated by the solid line 301, and includes 824 MHz to 960 MHz, that is, the section of a frequency of GSM850 and EGSM. Furthermore, the range of an operating frequency in a high frequency band is from about 1679 MHz to about 2182 MHz based on a reflection loss −6 dB indicated by the dotted lines 302, and includes 1710 MHz to 2170 MHz, that is, the section of a frequency of DCS, PCS and W2100.

In a metal body antenna having loop type radiation elements according to another embodiment of the present invention, as in an embodiment of FIGS. 4 and 5, the loop type radiation element can be reduced in size and may be disposed at a specific location between the end part of a frame bezel unit and a connection line.

Figure 4A:
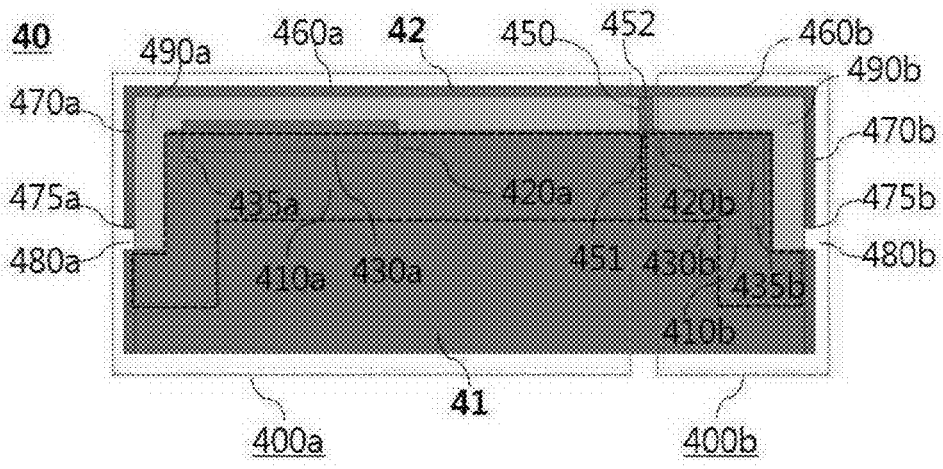
FIG. 4*a* is a case where the radiation element connected to the feeding power port is linear and reduced in size in FIG. 2 and is a detailed plan view showing an enlarged structure of the metal body antenna having loop type radiation elements.
Figure 4B:
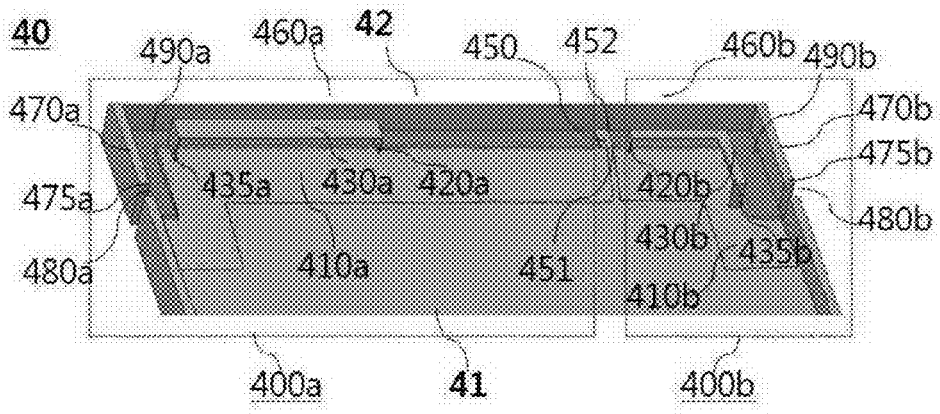
FIG. 4*b* is a case where the radiation element connected to the feeding power port is linear and reduced in size in FIG. 2 and is a detailed perspective view showing an enlarged structure of the metal body antenna having loop type radiation elements.

FIGS. 4*a* and 4*b* are diagrams showing the structure of an antenna according to another embodiment of the present invention. FIG. 4*a* is a plan view showing a detailed and enlarged structure of a metal body antenna in which the first feeding power port 420*a* of a first radiation element 430*a* is disposed between the end part 475*a* of a first side bezel unit 470*a* and a connection line 450. FIG. 4*b* is a perspective view showing a detailed and enlarged structure of a metal body antenna having small-sized loop type radiation elements in which the first feeding power port 420*a* of the first radiation element 430*a* is located between the end part 475*a* of the first side bezel unit 470*a* and the connection line 450.

The structure of FIGS. 4*a* and 4*b* has a small-sized antenna unit by securing a space within the housing unit 40, that is, by securing the space in which other elements and parts for a terminal are disposed.

In the metal body antenna having loop type radiation elements of FIGS. 4*a* and 4*b* according to an embodiment of the present invention, the first and the second radiation elements 430*a* and 430*b* have a small-sized linear structure, and a first bezel unit 460*a* and a second bezel unit 460*b* are supplied with an electromagnetic signal from a connection line 450 at a common location having the same start point.

Accordingly, the first radiation element 430*a* may be disposed in a specific location of the space between the connection line 450 and the end part 475*a* of the first side bezel unit 470*a*. The second radiation element 430*b* may be disposed in a specific location of the space between the connection line 450 and the end part 475*b* of the second side bezel unit 470*b*.

An operating principle of the metal body antenna using the small-sized radiation elements shown in FIGS. 4*a* and 4*b* is the same as that of the antenna using the linear radiation elements shown in FIG. 3*a*.

Figure 4C:
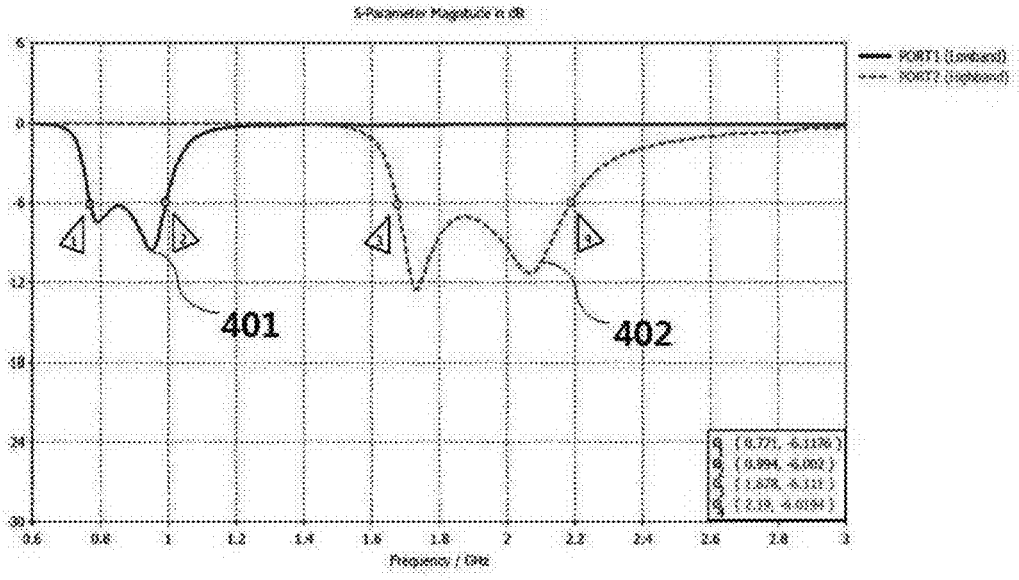
FIG. 4*c* is a case where the radiation element connected to the feeding power port is linear and reduced in size in FIGS. 4*a* and 4*b* and shows a reflection loss of the metal body antenna.

FIG. 4*c* is a diagram showing a reflection loss of the metal body antenna using the small-sized radiation elements shown in FIGS. 4*a* and 4*b*.

Referring to FIG. 4*c*, the range of an operating frequency in a low frequency band is from about 771 MHz to about 994 MHz based on a reflection loss −6 dB indicated by a solid line 401, and includes 824 MHz to 960 MHz, that is, the section of a frequency of GSM850 and EGSM. The range of an operating frequency in a high frequency band is from about 1678 MHz to about 2190 MHz based on a reflection loss −6 dB indicated by dotted lines 402, and includes 1710 MHz to 2170 MHz, that is, the section of a frequency of DCS, PCS or W2100.

Figure 5A:
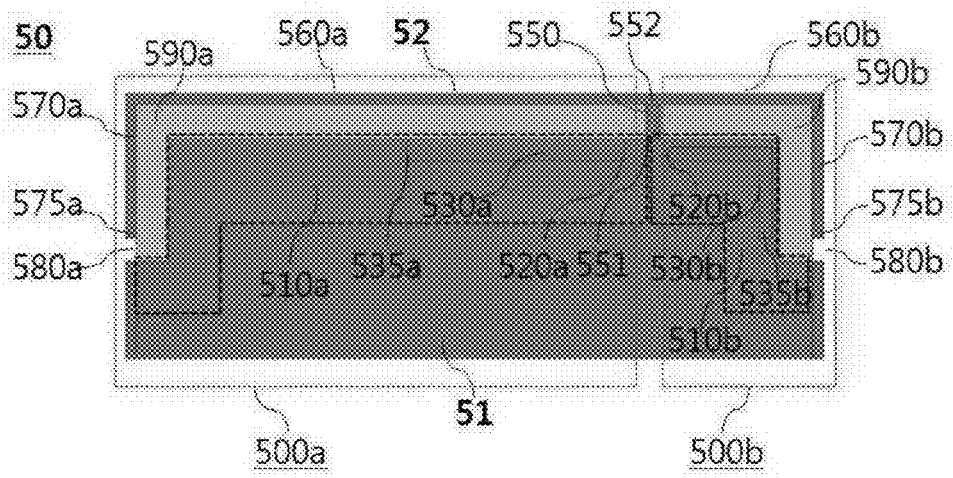
FIG. 5*a* is a case where the radiation element connected to the feeding power port is linear and reduced in size in FIG. 2 and is a detailed plan view showing an enlarged structure of the metal body antenna having loop type radiation elements.
Figure 5B:
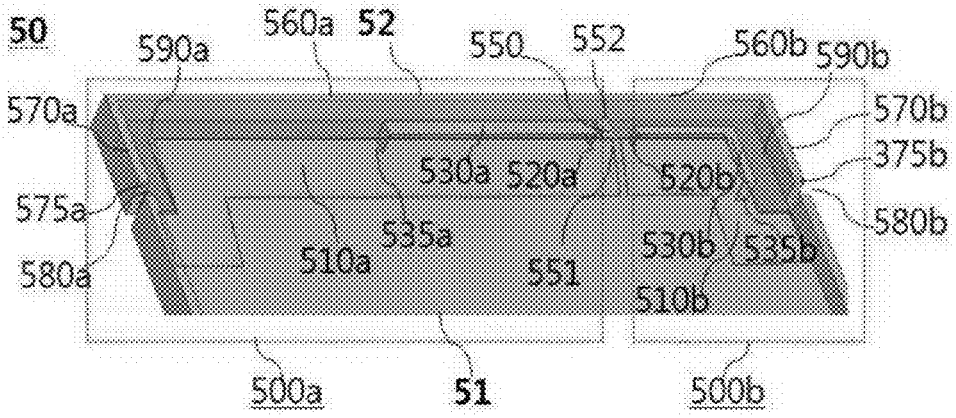
FIG. 5*b* is a case where the radiation element connected to the feeding power port is linear and reduced in size in FIG. 2 and is a detailed perspective view showing an enlarged structure of the metal body antenna having loop type radiation elements.

FIGS. 5*a* and 5*b* are diagrams showing the structure of an antenna according to yet another embodiment of the present invention. FIG. 5*a* is a plan view showing a detailed and enlarged structure of a metal body antenna having small-sized loop type radiation elements in which the first end part 575*a* of a first radiation element 530*a* may be disposed at a specific location in the space between a connection line 550 and the end part 575*a* of a first side bezel unit 570*a*. FIG. 5*b* is a perspective view showing a detailed and enlarged structure of a metal body antenna having loop type radiation elements in which the first end part 575*a* of the first radiation element 530*a* may be disposed at a specific location in the space between the connection line 550 and the end part 575*b* of the first side bezel unit 570*a*.

In the metal body antenna having loop type radiation elements shown in FIGS. 5*a* and 5*b* according to an embodiment of the present invention, the first and the second radiation elements 530*a* and 530*b* have a small-sized linear structure, and a first bezel unit 560*a* and a second bezel unit 560*b* are supplied with an electromagnetic signal from the connection line 550 at a common location having the same start point.

Accordingly, the first radiation element 530*a* may be disposed at a specific location in the space between the connection line 550 and the end part 575*a* of the first side bezel unit 570*a*. The second radiation element 530*b* may be disposed at a specific location in the space between the connection line 550 and the end part 575*b* of the second side bezel unit 570*b*.

An operating principle of the metal body antenna using the small-sized radiation elements shown in FIGS. 5*a* and 5*b* is the same as that of the antenna using the linear radiation elements shown in FIG. 3*a*.

Figure 5C:
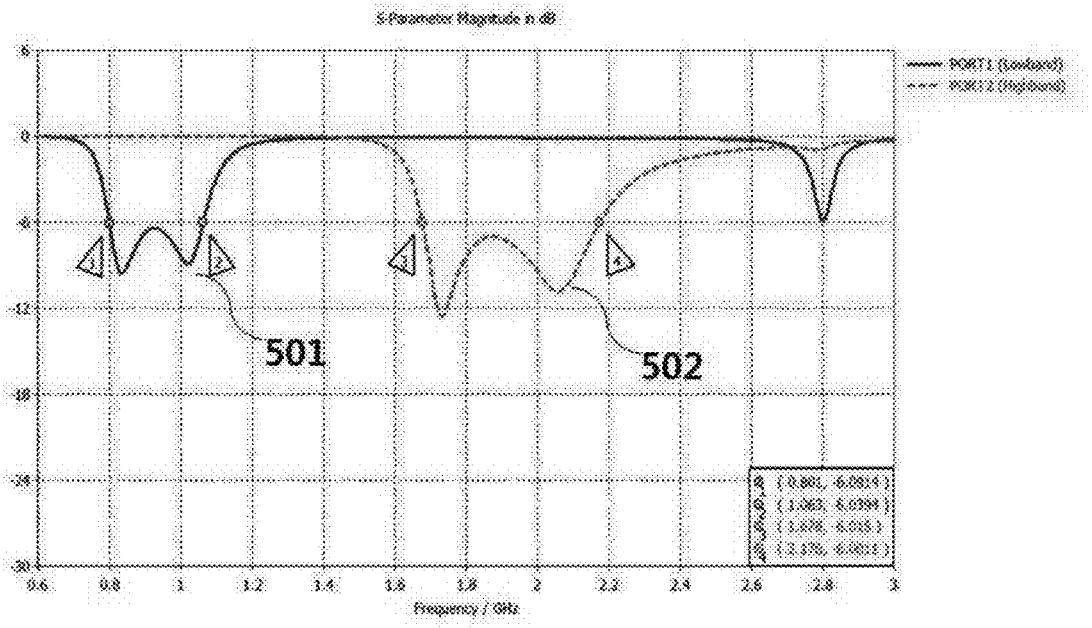
FIG. 5*c* is a case where the radiation element connected to the feeding power port is linear and reduced in size in FIGS. 5*a* and 5*b* and shows a reflection loss of the metal body antenna.

FIG. 5*c* is a diagram showing a reflection loss of the metal body antenna using the small-sized radiation elements shown in FIGS. 5*a* and 5*b*.

Referring to FIG. 5*c*, the range of an operating frequency in a low frequency band is from about 801 MHz to about 1063 MHz based on a reflection loss −6 dB indicated by a solid line 501, and includes 824 MHz to 960 MHz, that is, the section of a frequency of GSM850 and EGSM. The range of an operating frequency in a high frequency band is from about 1678 MHz to about 2176 MHz based on a reflection loss −6 dB indicated by dotted lines 502, and includes 1710 MHz to 2170 MHz, that is, the section of a frequency of DCS, PCS and W2100.

As described above, the metal body antenna having loop type radiation elements according to an embodiment of the present invention has an advantage in that it shows a wideband characteristic in the Penta Band (i.e., GSM850, EGSM, DCS, PCS, and W2100), that is, a band chiefly used in mobile phones because the metal body antenna has a multi-antenna structure of a wideband using the frame bezel unit and having a small radiation loss.

Furthermore, the metal body antenna having loop type radiation elements according to an embodiment of the present invention has an advantage in that it shows a wideband characteristic in multiple bands because the radiation element supplied with a signal from the feeding power port is not coupled to the frame bezel unit as a radiation element coupled to the ground, but the radiation element supplied with a signal from the feeding power port is coupled to the ground by loop coupling.

Furthermore, the metal body antenna having loop type radiation elements according to an embodiment of the present invention has an advantage in that it shows a wideband characteristic in multiple bands because the radiation element supplied with a signal from the feeding power port induces an electric current into the ground, magnetic energy is concentrated around the connection line that connects the ground and the upper bezel unit by a surface current flowing into the frame bezel unit as a radiation element connected to the ground by the electric current induced into the ground, and electric energy is concentrated on the open end part of the side bezel unit.

Furthermore, the metal body antenna having loop type radiation elements according to an embodiment of the present invention has an advantage in that it shows a wideband characteristic in multiple bands because the L-C element is inserted into the feeding power port and perfect impedance matching with the antenna unit is performed in an operating frequency band.

Although the embodiments of the present invention have been described in detail so far, it is evident that the embodiments are only illustrative, but are not limitative. It should be understood that a change of elements to the extent that the change may be equivalently handled without departing from the technical spirit or field of the present invention provided by the attached claims falls within the scope of the present invention.

What is claimed is:

1. A metal body antenna having loop type radiation elements in a housing unit, the metal body antenna comprising:

a first antenna unit having an electrical length of a half wavelength and comprising:

a first radiation element supplied with a signal of a low frequency band from a first feeding power port formed in the housing unit, a ground formed in the housing unit and coupled to the first radiation element by loop coupling to generate an induction current, a connection line connected to the ground, and a frame bezel unit connected to the connection line and opened by a gap; and a second antenna unit having an electrical length of a half wavelength and comprising:

a second radiation element supplied with a signal of a high frequency band from a second feeding power port formed in the housing unit, a ground formed in the housing unit and coupled to the second radiation element by loop coupling to generate an induction current, a connection line connected to the ground, and a frame bezel unit connected to the connection line and opened by a gap.

2. The metal body antenna of claim 1, wherein:

the frame bezel unit is separated from the ground by a dielectric and a gap; and the connection line is configured on the dielectric to connect the ground and the frame bezel unit so that the induction current flows into the frame bezel unit.

3. The metal body antenna of claim 1, wherein the frame bezel unit surrounds an outermost edge part of the ground.

4. The metal body antenna of claim 1, wherein the frame bezel unit is formed on an outskirt of the housing unit.

5. The metal body antenna of claim 1, wherein the first radiation element and the second radiation element are formed on both sides of the ground based on the connection line.

6. The metal body antenna of claim 2, wherein the first radiation element and the second radiation element are formed on both sides of the ground based on the connection line.

7. The metal body antenna of claim 3, wherein the first radiation element and the second radiation element are formed on both sides of the ground based on the connection line.

8. The metal body antenna of claim 4, wherein the first radiation element and the second radiation element are formed on both sides of the ground based on the connection line.

9. The metal body antenna of claim 1, wherein L-C elements are inserted between the first feeding power port and the first radiation element, and between the second feeding power port and the second radiation element, respectively.

10. The metal body antenna of claim 2, wherein L-C elements are inserted between the first feeding power port and the first radiation element, and between the second feeding power port and the second radiation element, respectively.

11. The metal body antenna of claim 3, wherein L-C elements are inserted between the first feeding power port and the first radiation element, and between the second feeding power port and the second radiation element, respectively.

12. The metal body antenna of claim 4, wherein L-C elements are inserted between the first feeding power port and the first radiation element, and between the second feeding power port and the second radiation element, respectively.

13. The metal body antenna of claim 1, wherein the first radiation element and the second radiation element are each disposed at a specific location above the ground between the gap and the connection line.

14. The metal body antenna of claim 2, wherein the first radiation element and the second radiation element are each disposed at a specific location above the ground between the gap and the connection line.

15. The metal body antenna of claim 3, wherein the first radiation element and the second radiation element are each disposed at a specific location above the ground between the gap and the connection line.

16. The metal body antenna of claim 4, wherein the first radiation element and the second radiation element are each disposed at a specific location above the ground between the gap and the connection line.

* * * * *